US009390673B2

(12) United States Patent
Tanaka et al.

(10) Patent No.: US 9,390,673 B2
(45) Date of Patent: Jul. 12, 2016

(54) LIQUID CRYSTAL DISPLAY DEVICE AND METHOD OF DRIVING THE SAME

(71) Applicant: Japan Display Inc., Minato-ku (JP)

(72) Inventors: Yukio Tanaka, Tokyo (JP); Toshiyuki Higano, Tokyo (JP); Kenji Nakao, Tokyo (JP); Hirofumi Wakemoto, Tokyo (JP)

(73) Assignee: Japan Display Inc., Minato-ku (JP)

( * ) Notice: Subject to any disclaimer, the term of this patent is extended or adjusted under 35 U.S.C. 154(b) by 293 days.

(21) Appl. No.: 14/032,523

(22) Filed: Sep. 20, 2013

(65) Prior Publication Data

US 2014/0085356 A1 Mar. 27, 2014

(30) Foreign Application Priority Data

Sep. 26, 2012 (JP) ..... 2012-212563

(51) Int. Cl.
*G09G 5/10* (2006.01)
*G09G 3/36* (2006.01)

(52) U.S. Cl.
CPC ..... *G09G 3/3696* (2013.01); *G09G 3/3614* (2013.01); *G09G 2320/046* (2013.01); *G09G 2330/021* (2013.01)

(58) Field of Classification Search
None
See application file for complete search history.

(56) References Cited

U.S. PATENT DOCUMENTS

2003/0132903 A1* 7/2003 Ueda ..... G09G 3/3614 345/87
2003/0156086 A1* 8/2003 Maeda ..... G06F 3/14 345/89
2004/0223006 A1* 11/2004 Nakayama ..... G09G 3/3648 345/690
2008/0170025 A1 7/2008 Song et al.
2012/0050147 A1* 3/2012 Iwasa ..... G09G 3/3614 345/96

FOREIGN PATENT DOCUMENTS

CN 1637544 A 7/2005
CN 101071213 A 11/2007
JP 2002-14363 1/2002
JP 2007-298801 A 11/2007
JP 2010-281981 A 12/2010
JP 2011-112865 6/2011

OTHER PUBLICATIONS

Japanese Office Action issued Nov. 4, 2015 in Patent Application No. 2012-212563 (with English translation).
Combined Chinese Office Action and Search Report issued Sep. 1, 2015 in Patent Application No. 201310445585.3 (with English language translation).

* cited by examiner

*Primary Examiner* — Joseph Feild
*Assistant Examiner* — Henok Heyi
(74) *Attorney, Agent, or Firm* — Oblon, McClelland, Maier & Neustadt, L.L.P.

(57) ABSTRACT

According to one embodiment, a liquid crystal display device includes an array substrate, a counter substrate, a liquid crystal layer and a driving unit. The driving unit is configured to perform polarity inversion driving by applying, to the pixel electrode, positive and negative video signals. When applying the video signals to the pixel electrode, the driving unit superposes a correction signal corresponding to a polarity inversion frequency and the gray level on the video signals in advance.

16 Claims, 10 Drawing Sheets

| Frame inversion frequency | No signal correction | Signal correction of first embodiment | Signal correction of second embodiment | Signal correction of comparative example |
|---|---|---|---|---|
| 60Hz | 0.0118 (100.0%) | 0.0090 (76.0%) | 0.0046 (38.8%) | 0.0090 (76.0%) |
| 15Hz | 0.0155 (100.0%) | 0.0099 (64.1%) | 0.0047 (30.4%) | 0.0111 (71.9%) |
| 0.9375Hz | 0.0242 (100.0%) | 0.0117 (48.3%) | 0.0047 (19.5%) | 0.0172 (71.1%) |

LIQUID CRYSTAL DISPLAY DEVICE AND METHOD OF DRIVING THE SAME

CROSS-REFERENCE TO RELATED APPLICATIONS

This application is based upon and claims the benefit of priority from Japanese Patent Application No. 2012-212563, filed Sep. 26, 2012, the entire contents of which are incorporated herein by reference.

FIELD

Embodiments described herein relate generally to a liquid crystal display device and a method of driving the same.

BACKGROUND

Liquid crystal display devices are incorporated into various apparatuses such as a television receiver, automobile displays such as a car navigation apparatus, and mobile terminals such as a notebook computer and cellular phone.

For example, in a TN (Twisted Nematic)-mode or OCB (Optically Compensated Bend)-mode liquid crystal display device, the orientation direction of liquid crystal molecules contained in a liquid crystal layer held between upper and lower substrates is controlled by an electric field formed between a counterelectrode of the upper substrate and a pixel electrode of the lower substrate.

Also, in an IPS (In-Plane Switching)-mode or FFS (Fringe-Field Switching)-mode liquid crystal display device, both the counterelectrode (in this case, a COM electrode) and the pixel electrode are provided on one substrate, and the orientation direction of liquid crystal modules contained in a liquid crystal layer is controlled by an electric field (fringe electric field) formed between the two electrodes. The FFS-mode liquid crystal display device has a high luminance because a high aperture ratio can be secured, and also has a good viewing angle characteristic.

DETAILED DESCRIPTION

Figure 1:
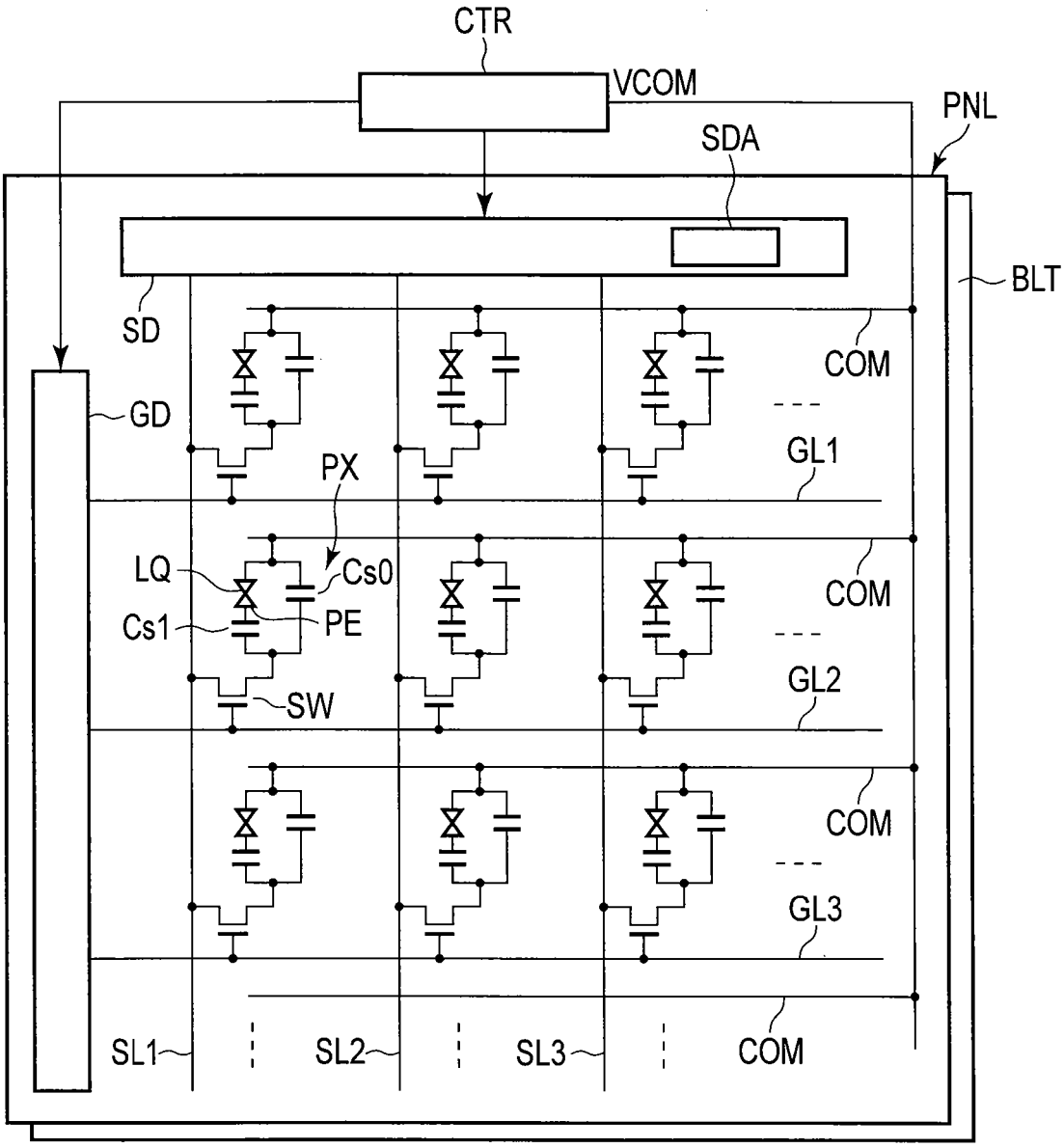
FIG. 1 is a schematic view showing an arrangement example of a liquid crystal display device according to a first embodiment.

In general, according to one embodiment, there is provided a liquid crystal display device comprising: an array substrate comprising a pixel electrode forming a pixel, and a counter-electrode arranged opposite to the pixel electrode with an insulating layer being interposed between them, and forming the pixel, a counter substrate arranged opposite to the array substrate, a liquid crystal layer held between the array substrate and the counter substrate, and a driving unit configured to perform polarity inversion driving by applying, to the pixel electrode, positive and negative video signals corresponding to a gray level of an image to be displayed by the pixel, wherein when applying the video signals to the pixel electrode, the driving unit superposes a correction signal corresponding to a polarity inversion frequency and the gray level on the video signals in advance.

According to another embodiment, there is provided a method of driving a liquid crystal display device, the liquid crystal display device comprising an array substrate including a pixel electrode forming a pixel, and a counterelectrode arranged opposite to the pixel electrode with an insulating layer being interposed therebetween and forming the pixel, a counter substrate arranged opposite to the array substrate, a liquid crystal layer held between the array substrate and the counter substrate, and a driving unit, the method comprising performing polarity inversion driving by applying, to the pixel electrode, positive and negative video signals corresponding to a gray level of an image to be displayed by the pixel by the driving unit, and when applying the video signals to the pixel electrode, superposing a correction signal corresponding to a polarity inversion frequency and the gray level on the video signals in advance by the driving unit.

First, the idea of the embodiments of the present invention will be explained.

An image burn-in phenomenon sometimes occurs in an FFS-mode liquid crystal display device. Various factors cause this image burn-in. One known example is a state in which a DC operating point shifts due to the electric charge accumulation (charge-up) resulting from a display gray level in an interface between insulating film and alignment film in a pixel slit portion or an interface between alignment film and liquid crystal. Another known example is a state caused by an insufficient liquid crystal orientation anchoring strength.

As a means for suppressing this image burn-in phenomenon, a system including a correcting means for correcting a voltage to be applied to a pixel electrode in accordance with a gray level by applying a preset DC bias having a predetermined magnitude to the voltage has been proposed as disclosed in, e.g., Jpn. Pat. Appln. KOKAI Publication No. 2011-112865. This system can provide a liquid crystal display device and a method of driving the same that improve the display quality by suppressing the image burn-in phenomenon.

It is necessary to reduce the circuit power consumption in a liquid crystal display device for a mobile terminal, particularly, a smartphone, and low-frequency driving and intermittent driving have been proposed as means for this purpose. The low-frequency driving is a method of reducing the circuit power by decreasing the driving frequency of a liquid crystal display device to, e.g., ½ or ¼ that of the standard conditions. The intermittent driving is a method of reducing the circuit power by inserting a circuit pause period having a few frames after write is performed in one display period (one frame) of a liquid crystal display device.

In either method, a side effect such as a moving image blur may occur because a video signal rewrite frequency decreases. However, each method is an effective circuit power reducing means when, e.g., displaying a still image for which the moving image visibility is not important. Note that in either method, a polarity inversion frequency necessarily decreases when the video signal rewrite frequency is decreased.

When the technique disclosed in Jpn. Pat. Appln. KOKAI Publication No. 2011-112865 was applied to the low-frequency driving and intermittent driving described above, it was impossible to obtain a desired image burn-in improving effect.

Accordingly, the embodiments of the present invention have been made to solve this problem, and can provide a liquid crystal display device and a method of driving the same that improve the display quality by suppressing the image burn-in phenomenon even in a liquid crystal display device using the low-frequency driving or intermittent driving. A remarkable image burn-in reducing effect can be obtained especially when decreasing the frame inversion frequency in order to reduce the driving power. This makes it possible to achieve both a low power consumption and the image burn-in reducing effect. Means for embodying the above-mentioned idea in order for the embodiments of the present invention to solve the above problem will be explained below.

A liquid crystal display device and a method of driving the liquid crystal display device according to the first embodiment will be explained in detail below with reference to the accompanying drawing.

As shown in FIG. 1, the liquid crystal display device comprises a liquid crystal display panel PNL comprising a display unit including pixels PX arranged in a matrix, and a backlight unit BLT as an illuminating means for illuminating the liquid crystal display panel from the backside.

Figure 2:
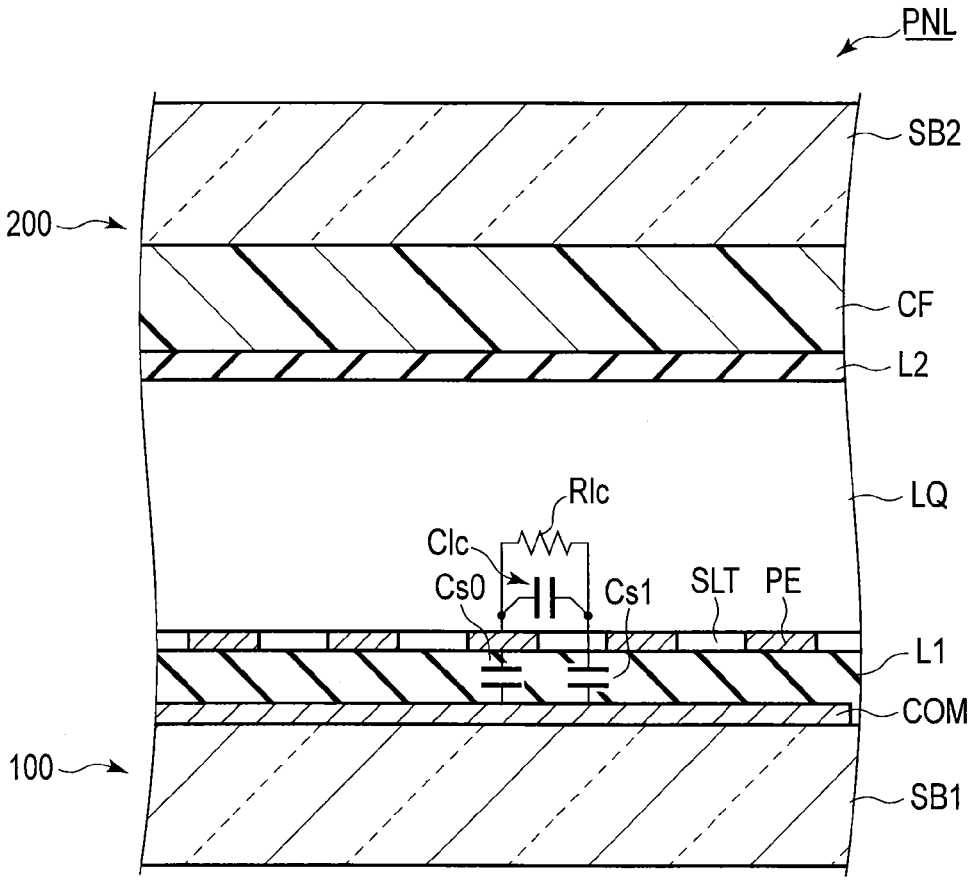
FIG. 2 is a view showing an example of the section of the liquid crystal display device.

As shown in FIG. 2, the liquid crystal display panel PNL comprises a pair of substrates 100 and 200, and a liquid crystal layer LQ held between the pair of substrates 100 and 200. One of the pair of substrates is a counter substrate 200 comprising a transparent insulating substrate SB2, a color filter CF including colored layers of red (R), green (G), and blue (B) arranged on the transparent insulating substrate SB2, and an overcoat layer L2 covering the color filter CF. The overcoat layer L2 prevents materials contained in the color filter CF from flowing out to the liquid crystal layer LQ.

The other one of the pair of substrates is an array substrate 100 comprising a transparent insulating substrate SB1, a counterelectrode (first electrode) COM, and a plurality of pixel electrodes (second electrodes) PE arranged on an insulating layer L1 made of, e.g., silicon nitride (SiN) and face the counterelectrode COM. The pixel electrodes PE are arranged in one-to-one correspondence with the pixels PX, and slit-like holes SLT are formed in the pixel electrode PE. The counter electrode COM and pixel electrodes PE are transparent electrodes made of, e.g., ITO (Indium Tin Oxide).

In the display unit as shown in FIG. 1, the array substrate 100 comprises scanning lines GL (GL1, GL2, . . . ) running along rows in which the plurality of pixels PX are arrayed, signal lines SL (SL1, SL2, . . . ) running along columns in which the plurality of pixels PX are arrayed, and pixel switches SW arranged near the intersections of the scanning lines GL and signal lines SL.

The pixel switch SW comprises a TFT (Thin-Film Transistor). The gate electrode of the pixel switch SW is electrically connected to the corresponding scanning line GL, and faces the semiconductor layer. The source electrode of the pixel switch SW is electrically connected to the corresponding signal line SL, and is also electrically connected to the source region of the semiconductor layer. The drain electrode of the pixel switch SW is electrically connected to the corresponding pixel electrode PE, and is also electrically connected to the drain region of the semiconductor layer.

The array substrate 100 comprises a gate driver GD and source driver SD as driving means for driving the plurality of pixels PX. The plurality of scanning lines GL are electrically connected to the output terminals of the gate driver GD. The plurality of signal lines SL are electrically connected to the output terminals of the source driver SD.

The gate driver GD and source driver SD are arranged in the peripheral region of the display unit. The gate driver GD sequentially applies an ON voltage to the scanning lines SL, and applies the ON voltage to the gate electrodes of the pixel switches SW electrically connected to a selected scanning line GL. An electric current flows between the source electrode and drain electrode of a pixel switch to the gate electrode of which the ON voltage is applied. The source driver SD supplies corresponding output signals (video signals) to the signal lines SL. The signal supplied to each signal line SL is applied to the corresponding pixel electrode PE via the pixel switch SW in which an electric current flows between the source electrode and drain electrode.

A controller CTR arranged outside the liquid crystal display panel PNL controls the operations of the gate driver GD and source driver SD. The controller CTR applies a countervoltage Vcom to the counterelectrode COM. The gate driver GD, source driver SD, and controller CTR function as a driving unit.

The controller CTR has a function (low-frequency driving function) of changing the driving frequency in order to reduce the driving power. As an example, assume that the standard frame inversion frequency of the liquid crystal display device is 60 Hz (i.e., the polarity of a voltage to be applied to a liquid crystal inverts every (1/60) sec). When displaying a moving image, the display device operates at 60 Hz. When displaying, e.g., a still image for which the moving image visibility is not important, however, the driving speed of the controller CTR is decreased to, e.g., 1/2, 1/4, 1/8, or 1/64, thereby setting the frame inversion frequency at 30, 15, 7.5, or 0.9375 Hz, respectively. By thus changing the driving speed in accordance with a display image, the power consumption for driving can be reduced. Note that in this driving, the scanning rate of the gate driver GD and source driver SD is also synchronously decreased to, e.g., 1/2, 1/4, 1/8, or 1/64.

Alternatively, the controller CTR may also have an intermittent driving function. For example, although a 60-Hz operation (i.e., an operation of performing full-screen write for (1/60) sec) is the basic operation, a pause period equivalent to, e.g., 1 frame, 3 frames, 7 frames, or 63 frames is inserted after write (scanning from the upper end to the lower end of the screen) of 1 frame (=(1/60) sec) is performed when, e.g., displaying a still image. When the operation of the controller CTR is stopped in this pause period, the circuit power consumption during this period is practically 0 (zero), and the circuit power consumption averaged by the time including the write time is reduced to 1/2, 1/4, 1/8, or 1/64.

A signal written in each pixel must be held in it for a long time in the driving as described above, so it is desirable to use a TFT having a small off-leakage current and hence suited to low-frequency driving. An example of the TFT is a TFT including a semiconductor layer made of, e.g., IGZO (an oxide containing In (indium), Ga (gallium), and Zn (zinc)).

As shown in FIGS. 1 and 2, the liquid crystal display device according to this embodiment is an FFS (Fringe-Field Switching)-mode liquid crystal display device in which voltages are applied to the counterelectrode COM and pixel electrodes PE, and an electric field is generated in the liquid crystal layer LQ by the potential difference between the counterelectrode COM and pixel electrodes PE, thereby controlling the orientation direction of liquid crystal molecules contained in the liquid crystal layer. The orientation direction of the liquid crystal molecules controls the transmission amount of light emitted by the backlight unit BLT. Note that the controller CTR controls the operation of the backlight unit BLT.

Figure 3:
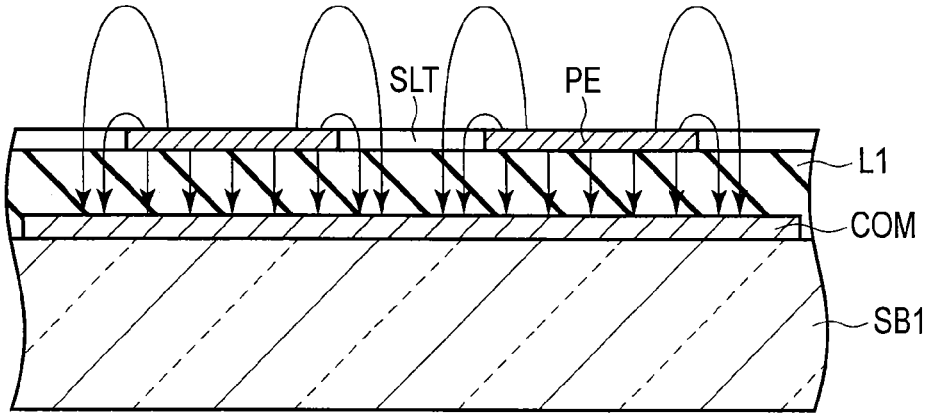
FIG. 3 is a view showing an example of the section of an array substrate of the liquid crystal display device, and is a view for explaining an example of an electric field generated between electrodes arranged with an insulating layer being interposed between them in an FFS mode.

As shown in FIG. 3, i.e., when voltages are applied between the counterelectrode COM and pixel electrodes PE, an electric field goes around not only portions where the two electrodes oppose to each other, but also those portions of the liquid crystal layer LQ which oppose the slits SLT of the pixel electrode PE (this electric field is called a fringe electric field). The FFS-mode liquid crystal display device controls the orientation direction of liquid crystal molecules by this fringe electric field.

As shown in FIGS. 1 and 2, a capacitance component Cs0 is naturally generated in a portion where the pixel electrode PE and counterelectrode COM oppose to each other with the insulating layer L1 being sandwiched between them. In addition to the capacitance component Cs0, an auxiliary capacitance component Cs1 and liquid crystal capacitance Clc corresponding to the electric field that goes around the liquid crystal layer LQ exist. Note that the liquid crystal layer LQ presumably has very slight conductivity resulting from residual ions or the like, so a leak path component (resistance component Rlc) parallel to the liquid crystal capacitance Clc also exists.

An image burn-in phenomenon sometimes occurs in the FFS-mode liquid crystal display device as described above. The image burn-in phenomenon is a phenomenon by which when, for example, a gray image (halftone image) is displayed on the entire surface of the display unit after a black-and-white checker pattern is displayed on the screen for a while, an afterimage of the checker pattern remains, like a residual image.

The liquid crystal display device according to this embodiment comprises a correcting means (correction unit) SDA for correcting an output signal to be supplied to the signal line SL, in order to suppress this image burn-in phenomenon, as will be described later. Note that the controller CTR can determine whether the voltage signal (video signal) is burned into the pixel electrode PE, based on, e.g., the time during which the voltage signal is continuously applied to the pixel electrode PE. The liquid crystal display device can be configured so that if the voltage signal is continuously applied to the pixel electrode PE for a predetermined time or more, the controller CTR controls the correcting means SDA to output a corrected voltage signal (video signal) as an output signal to the signal line SL.

In the liquid crystal display device according to the embodiment, a correction signal is preset in the correcting means SDA. For example, in the testing stage after the liquid crystal display device is manufactured, an image burn-in test is conducted to measure a series of luminance-Vcom characteristic curves as will be explained later, an optimal correction signal is calculated based on the measurement results, and the correcting means SDA is so adjusted as to output the calculated correction signal. In this embodiment, therefore, the correcting means SDA is so configured as to perform correction by which a correction signal corresponding to the polarity inversion frequency and the gray level of an image to be displayed on the pixel PX is superposed on an electrical signal (video signal) in advance, regardless of whether the voltage signal (video signal) is burned into the pixel electrode PE.

The luminance-Vcom characteristic curve described above is an important concept when analyzing an image burn-in state. Details are disclosed in Jpn. Pat. Appln. KOKAI Publication No. 2011-112865. Therefore, only the points of the luminance-Vcom characteristic curve will be explained below.

The luminance-Vcom characteristic curve is a graph plotting the luminance and the potential (Vcom) of the counter-electrode COM by changing the potential (Vcom) after a video signal having a specific display gray level (burn-in gray level) is burned into a pixel and the display gray level is switched to a gray level (measurement gray level) for evaluating the image burn-in. The abscissa represents a deviation (Vcom deviation) from a reference Vcom value corresponding to the burn-in. The luminance-Vcom characteristic curve generally has a parabola shape projecting downward. The apex coordinate along the abscissa (i.e., a point where the luminance is minimal) of the parabola is called a "minimal-luminance Vcom deviation", and the apex coordinate along the ordinate (i.e., the minimal value of the luminance) is called a "luminance bottom level".

The luminance-Vcom characteristic curve generally shifts in the horizontal or perpendicular direction when an image burn-in occurs. That is, even when the measurement gray level is constant, the minimal-luminance Vcom deviation and luminance bottom level take different values if the burn-in gray level changes. An image burn-in occurring due to the dependence of the minimal-luminance Vcom deviation on the burn-in gray level is called a "DC shift mode image burn-in". An image burn-in occurring due to the dependence of the luminance bottom level on the burn-in gray level is called a "luminance bottom level fluctuation mode image burn-in". Note that an actual visual image burn-in corresponds to a fluctuation width at the luminance (called an intercept luminance) at a point (Vcom deviation=0) where the luminance-Vcom characteristic curve corresponding to each burn-in gray level intersects the ordinate.

The primary factors of the DC shift mode image burn-in include, e.g., a factor (internal factor) caused by electric charge accumulation (chart-up) in an interface between the insulating film and alignment film in the pixel slit portion or an interface between alignment film and liquid crystal, and a factor (external factor) caused by the positive-negative asymmetry (DC offset) of the voltage to be applied to the liquid crystal. The minimal-luminance Vcom deviation (δV) can generally be represented by equation (1) below:

$$(\delta V)=(\text{pixel potential positive-negative average on measurement gray level})-(\text{pixel potential positive-negative average on burn-in gray level})+(\text{component resulting from display unit internal factor}) \quad (1)$$

On the other hand, the insufficiency of the liquid crystal orientation regulating force (anchoring force) is well known as the primary factor of the luminance bottom level fluctuation mode image burn-in. Also, the luminance bottom level fluctuation mode image burn-in sometimes occurs in addition to the DC shift mode image burn-in when charge-up occurs in the liquid crystal cell slit portion or the interface between the overcoat layer and alignment film described above. The luminance bottom level fluctuation mode image burn-in is mainly caused by the internal factor, and is generally independent of the positive-negative asymmetry (DC offset) of a voltage to be applied to a liquid crystal. One of the DC shift mode image burn-in and luminance bottom level fluctuation mode image burn-in is dominant in some cases, and they sometimes occur together as well.

Since low-frequency driving or intermittent driving is performed in this embodiment, the polarity inversion frequency of the voltage to be applied to the liquid crystal layer LQ becomes lower than the standard frequency in some cases.

The present inventors, therefore, measured luminance-Vcom characteristic curves after a burn-in at three polarity inversion frequencies of 60, 15, and 0.9375 Hz. Assume that the standard polarity inversion frequency is 60 Hz. Also, 15 Hz (¼ of the standard frequency) and 0.9375 Hz (1/64 of the standard frequency) are taken as examples of a frequency decreased by performing low-frequency driving or intermittent driving.

Figure 4:
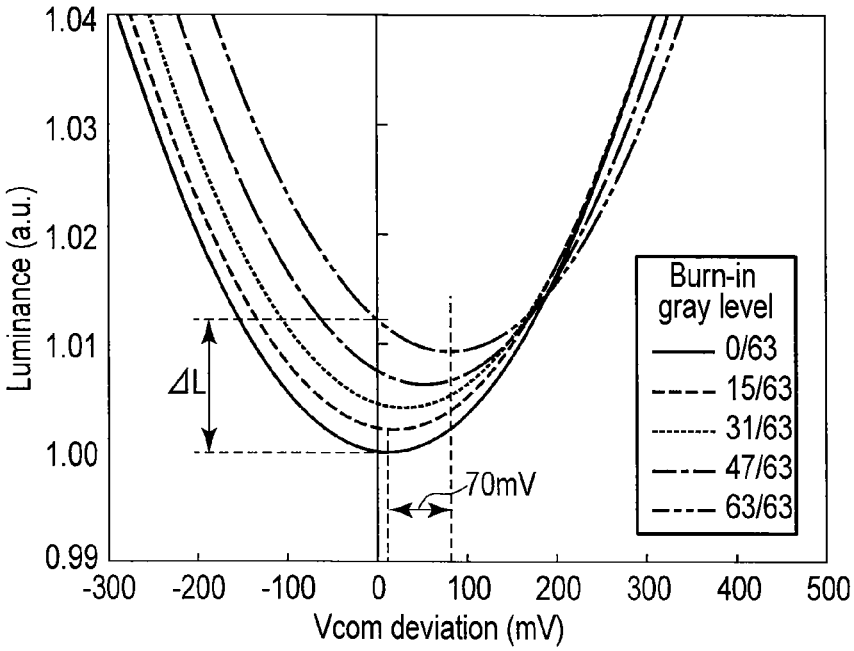
FIG. 4 is a graph showing the changes in luminance with respect to a Vcom deviation when a frame inversion frequency (polarity inversion frequency) is set at 60 Hz and a normal video signal is applied to a pixel electrode.
Figure 5:
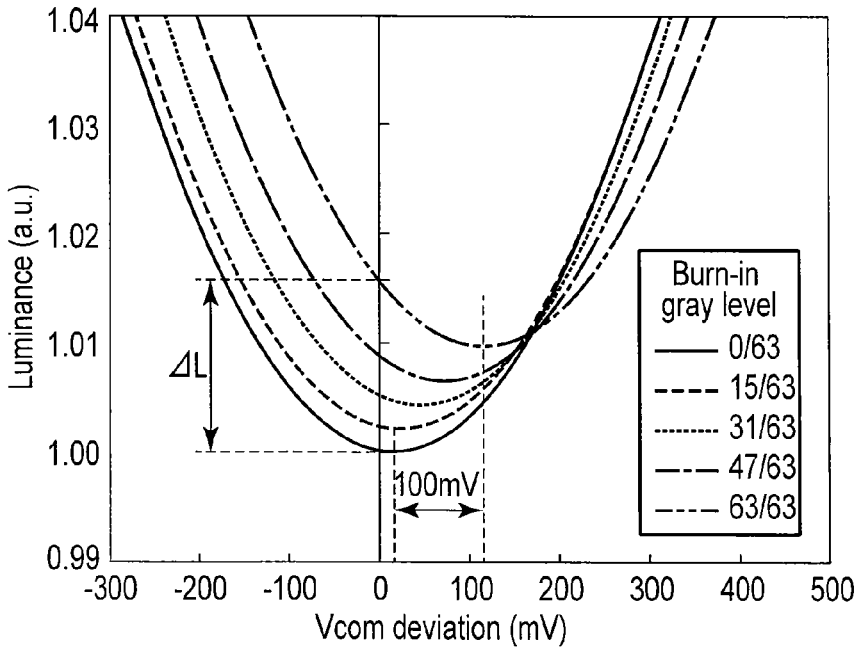
FIG. 5 is a graph showing the changes in luminance with respect to the Vcom deviation when the frame inversion frequency (polarity inversion frequency) is set at 15 Hz and the normal video signal is applied to the pixel electrode.
Figure 6:
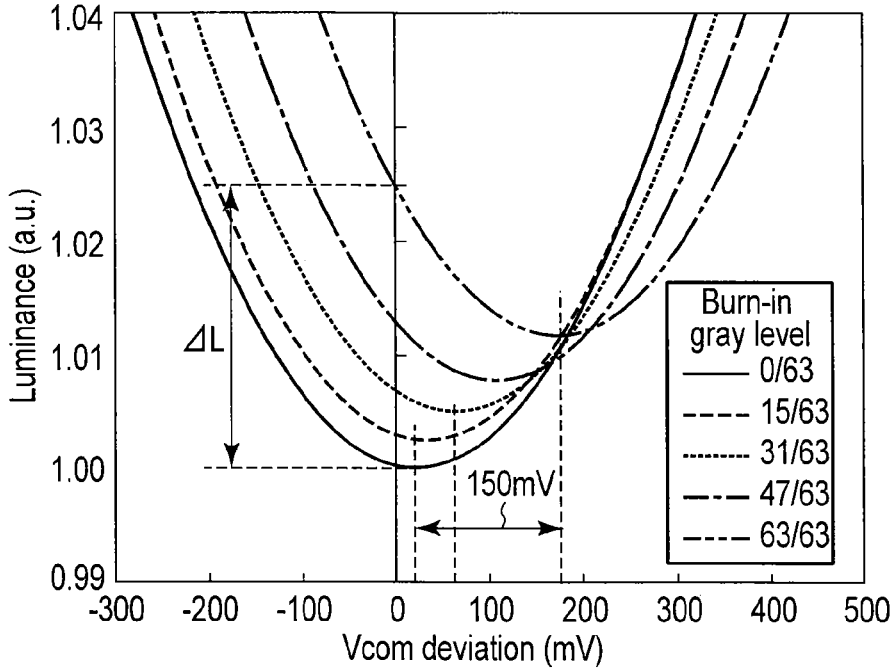
FIG. 6 is a graph showing the changes in luminance with respect to the Vcom deviation when the frame inversion frequency (polarity inversion frequency) is set at 0.9375 Hz and the normal video signal is applied to the pixel electrode.

FIGS. 4, 5, and 6 are graphs showing the changes in luminance with respect to the Vcom deviation at the different polarity inversion frequencies based on the above-mentioned measurement results.

As shown in FIGS. 4, 5, and 6, as gray levels, a black display state (level-5 gray level (0/63)) and a white display state (level-1 gray level (63/63)) were set, and a level-4 gray level (15/63), level-3 gray level (31/63), and level-2 gray level (47/63) were set as three gray levels at almost equal intervals between the black and white display states. The burn-in gray levels were five gray levels, i.e., levels 1 to 5, and the measurement gray level was the above-mentioned, level-3 gray level. In this measurement, the positive-negative average of the voltage to be applied to a pixel was set at 0 mV (a predetermined value independent of the gray level). Note that normalization was performed such that the luminance bottom level was 1.00 on a burn-in gray level of 0/63.

The measurement results reveal that as the polarity inversion frequency decreases, the dependence of the minimal-luminance Vcom deviation on the burn-in gray level increases. For example, the difference between the minimal-luminance Vcom deviations on burn-in gray levels of 0/63 and 63/63 is approximately 70 mV when the polarity inversion frequency is 60 Hz (FIG. 4), approximately 100 mV when the polarity inversion frequency is 15 Hz (FIG. 5), and approximately 150 mV when the polarity inversion frequency is 0.9375 Hz (FIG. 6).

The phenomenon in which the difference between the minimal-luminance Vcom deviations changes in accordance with the polarity inversion frequency as described above is a novel fact found by the present inventors by experiments and the like. The degree of image burn-in is given by the fluctuation width (ΔL in the drawing) of the intercept luminance. The values of ΔL are ΔL=0.0118 when the polarity inversion frequency is 60 Hz (FIG. 4), ΔL=0.0155 when the polarity inversion frequency is 15 Hz (FIG. 5), and ΔL=0.0242 when the polarity inversion frequency is 0.9375 Hz (FIG. 6). This demonstrates that when the positive-negative average of the voltages to be applied to a pixel has a predetermined value independent of the gray level, the degree of image burn-in increases as the polarity inversion frequency decreases.

Note that the dependence of the minimal-luminance Vcom deviation on the burn-in gray level increases as the polarity inversion frequency decreases perhaps because charge transfer in, e.g., an interface between the pixel electrode and alignment film has positive-negative asymmetry (rectification) like that of a diode, i.e., the period of polarity inversion becomes longer than the charge transfer time at low frequencies. This facilitates charge transfer, and increases the charge-up amount.

Based on the above-described results (FIGS. 4, 5, and 6), therefore, the correcting means SDA (source driver SD) of this embodiment superposes an offset voltage (correction signal) corresponding to the polarity inversion frequency and gray level on a video signal in advance.

Figure 7:
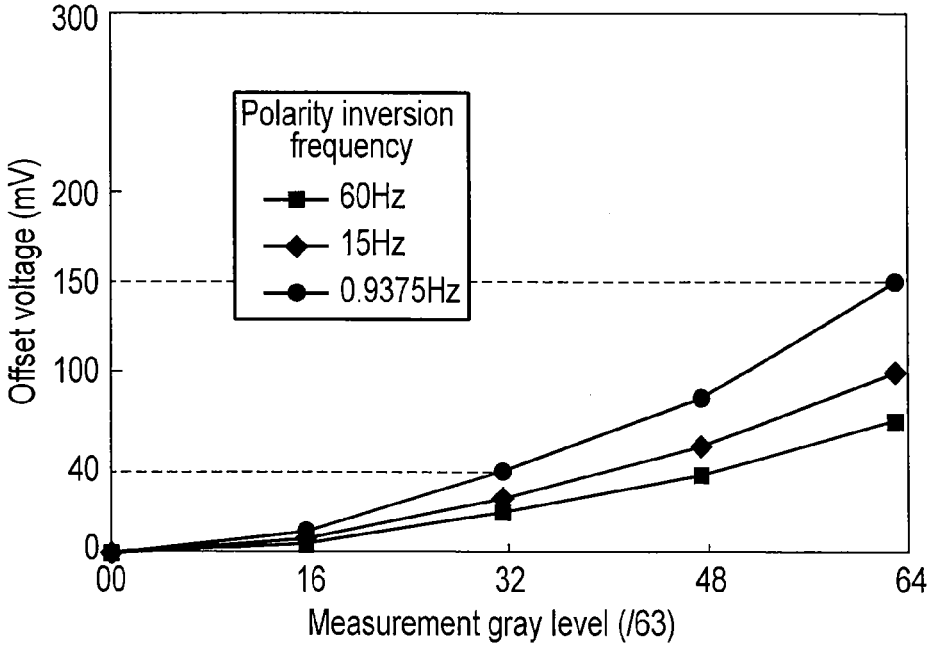
FIG. 7 is a graph showing the changes in offset voltage (correction signal) with respect to a measurement gray level at different frame inversion frequencies (polarity inversion frequencies) in the first embodiment.

FIG. 7 is a graph showing examples in which the offset voltage depending on the polarity inversion frequency and gray level are superposed on the average value (DC average value) of positive- and negative-polarity video signals output from the source driver SD. As shown in FIG. 7, the offset voltage having an independent value is superposed on the video signal in accordance with the polarity inversion frequency and gray level.

Figure 8:
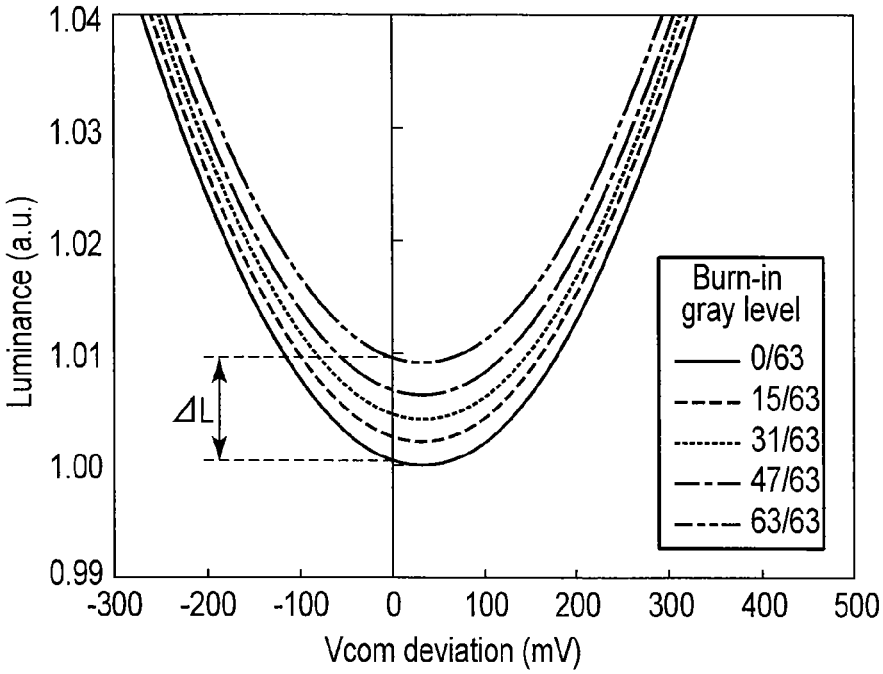
FIG. 8 is a graph showing the changes in luminance with respect to the Vcom deviation when the frame inversion frequency (polarity inversion frequency) is set at 60 Hz and a video signal on which the offset voltage (correction signal) is superposed is applied to the pixel electrode in the first embodiment.
Figure 9:
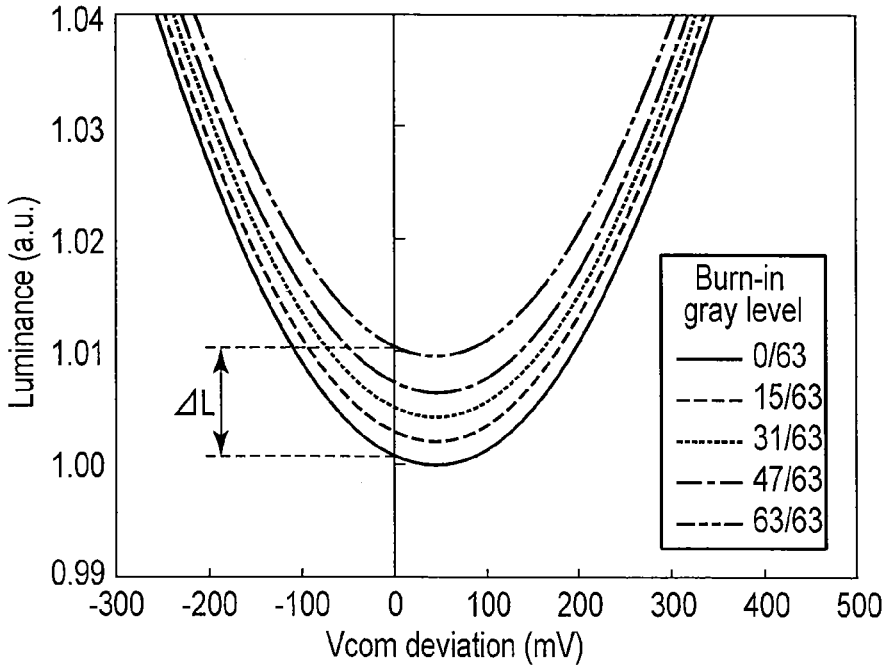
FIG. 9 is a graph showing the changes in luminance with respect to the Vcom deviation when the frame inversion frequency (polarity inversion frequency) is set at 15 Hz and the video signal on which the offset voltage (correction signal) is superposed is applied to the pixel electrode in the first embodiment.
Figure 10:
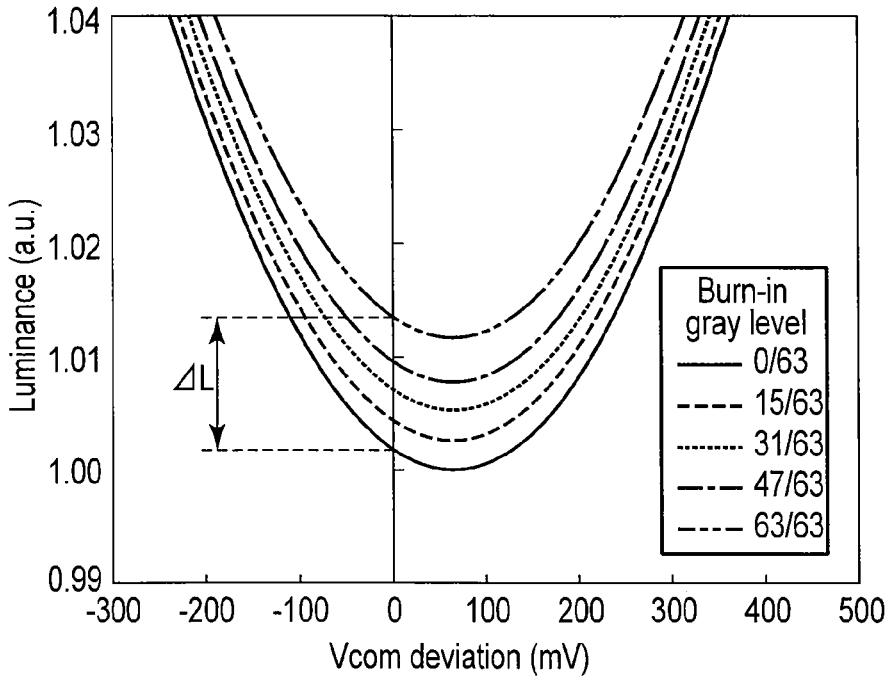
FIG. 10 is a graph showing the changes in luminance with respect to the Vcom deviation when the frame inversion frequency (polarity inversion frequency) is set at 0.9375 Hz and the video signal on which the offset voltage (correction signal) is superposed is applied to the pixel electrode in the first embodiment.

FIGS. 8, 9, and 10 are graphs showing the changes in luminance with respect to the Vcom deviation, which are expected when the video signal on which the offset voltage (FIG. 7) is superposed is applied to the pixel electrode. The measurement gray level is 31/63 (level-3 gray level) in FIGS. 8, 9, and 10 as well.

As shown in FIGS. 8, 9, and 10, regardless of whether the polarity inversion frequency is 60, 15, or 0.9375 Hz, the minimal-luminance Vcom deviations nearly match within almost the whole range of burn-in gray levels of 0/63 to 63/63. Note that the offset voltage (FIG. 7) is set by backward calculations so as to obtain the luminance-Vcom characteristic curves shown in FIGS. 8, 9, and 10.

In other words, the offset voltage (correction signal) is set such that the change amount of the countervoltage Vcom when the average luminance value of an image having a first gray level to be displayed by the pixel PX is minimal is equal to the change amount of the countervoltage Vcom when the average luminance value of an image having a second gray level to be displayed by the pixel PX is minimal, at each polarity inversion frequency.

This will be explained in detail below by taking a case in which the polarity inversion frequency is 0.9375 Hz as an example.

As shown in FIGS. 7 and 10, the offset voltage (offset correction amount) is 0 mV on the level-5 gray level (0/63, the black display state), 40 mV on the level-3 gray level (31/63), and 150 mV on the level-1 gray level (63/63, the white display state).

Referring to FIG. 6, the minimal-luminance Vcom deviation is 20 mV on the level-5 gray level (0/63, the black display state), 60 mV on the level-3 gray level (31/63), and 170 mV on the level-1 gray level (63/63, the white display state).

In equation (1) presented earlier, "the pixel potential positive-negative average on the measurement gray level" is "the offset voltage on the measurement gray level", "the pixel potential positive-negative average on the burn-in gray level" is "the offset voltage on the burn-in gray level", and "the component resulting from the display unit internal factor" is the minimal-luminance Vcom deviation shown in FIG. 6.

From the foregoing, the corrected minimal-luminance Vcom deviation (δV) can be calculated for each burn-in gray level by using equation (1):

Burn-in gray level=0/63

$$\delta V = 40\text{ mV} - 0\text{ mV} + 20\text{ mV} = 60\text{ mV}$$

Burn-in gray level=31/63

$$\delta V = 40\text{ mV} - 40\text{ mV} + 60\text{ mV} = 60\text{ mV}$$

Burn-in gray level=63/63

$$\delta V = 40\text{ mV} - 150\text{ mV} + 170\text{ mV} = 60\text{ mV}$$

From the foregoing, the minimal-luminance Vcom deviations certainly match.

That is, the video signal is corrected such that the bottom position of each luminance-Vcom characteristic curve shown in FIG. 6 is at 60 mV, and the curve is translated in the horizontal direction, thereby obtaining each luminance-Vcom characteristic curve as shown in FIG. 10.

Figures 18, 19:
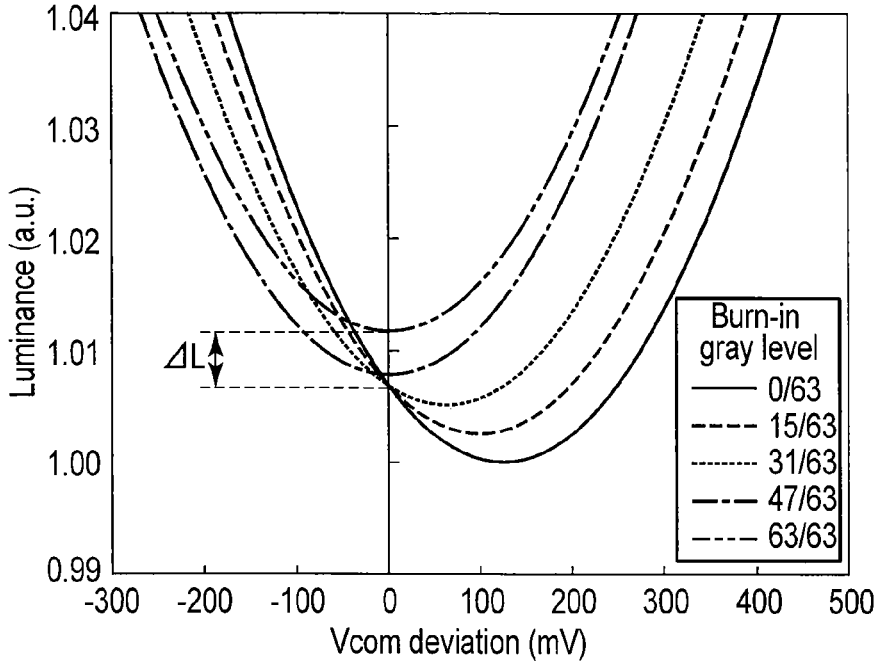
FIG. 18 is a graph showing the changes in luminance with respect to the Vcom deviation when the frame inversion frequency (polarity inversion frequency) is set at 0.9375 Hz and the video signal on which the offset voltage (correction signal) is superposed is applied to the pixel electrode in the second embodiment.
FIG. 19 is a view showing a table indicating the fluctuation width and its ratio of an intercept luminance for each frame inversion frequency (polarity inversion frequency), when no signal correction is performed, when signal correction of the first embodiment is performed, when signal correction of the second embodiment is performed, and when signal correction of the comparative example is performed.

FIG. 19 shows ΔL (the fluctuation width of the intercept luminance) as an image burn-in index in the upper half of each field, and the ratio (percentage) of ΔL at each frame inversion frequency (polarity inversion frequency) in the lower half of each field. The ratio of ΔL is represented based on the value when no signal correction is performed (when no correction of superposing the correction signal on the video signal is performed) (FIGS. 4, 5, and 6).

When signal correction (correction of superposing the correction signal on the video signal) of this embodiment is performed (FIGS. 8, 9, and 10), the ratio is lower than 100% at any polarity inversion frequency. This means that an image burn-in improves from that when no signal correction is performed.

For comparison, a liquid crystal display device of a comparative example that does not take account of the dependence on the polarity inversion frequency will be explained below.

Figure 11:
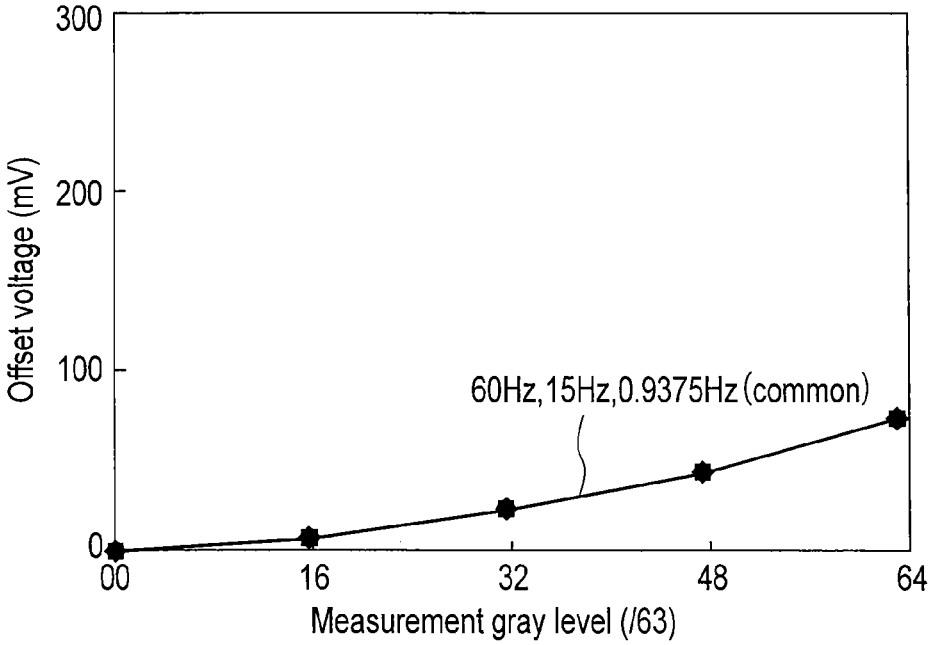
FIG. 11 is a graph showing the changes in offset voltage (correction signal) with respect to the measurement gray level, which is common to different frame inversion frequencies (polarity inversion frequencies) in a comparative example.

This comparative example adopts the offset voltage at 60 Hz (the standard polarity inversion frequency) regardless of the polarity inversion frequency. That is, the offset voltage as shown in FIG. 11 is superposed on a video signal.

Figure 12:
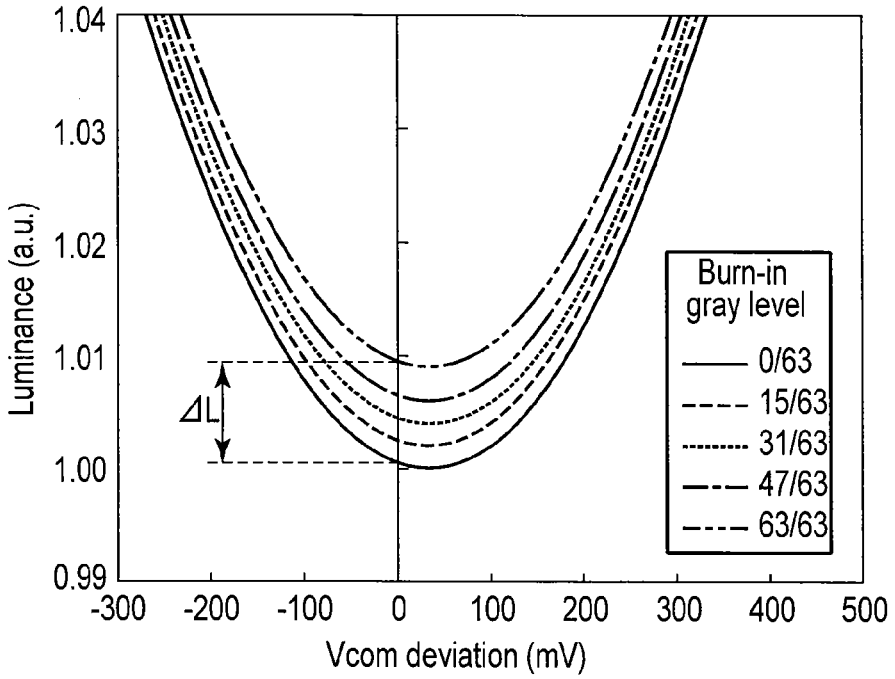
FIG. 12 is a graph showing the changes in luminance with respect to the Vcom deviation when the frame inversion frequency (polarity inversion frequency) is set at 60 Hz and the video signal on which the offset voltage (correction signal) is superposed is applied to the pixel electrode in the comparative example.
Figure 13:
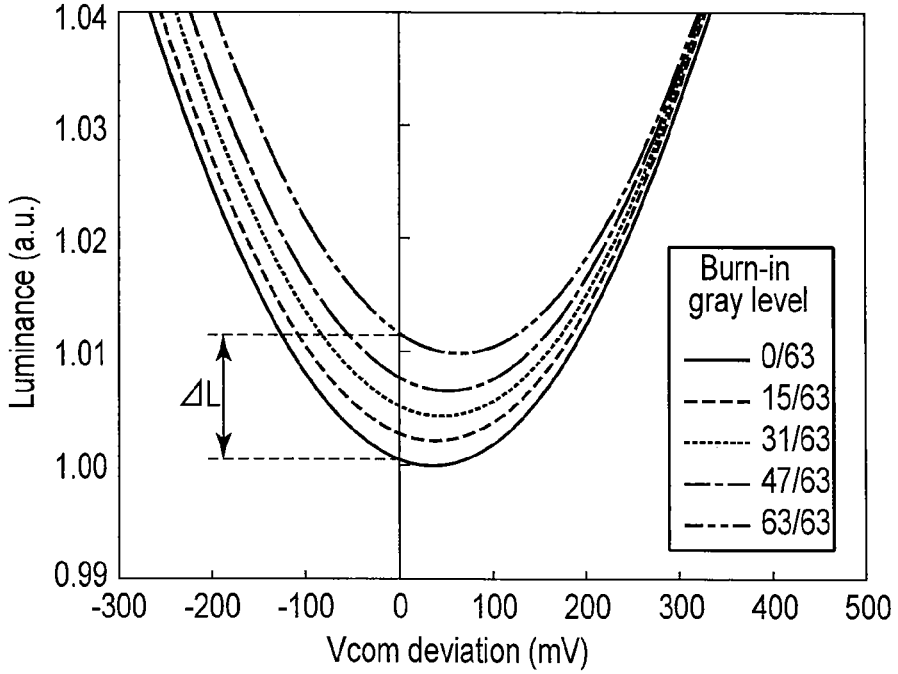
FIG. 13 is a graph showing the changes in luminance with respect to the Vcom deviation when the frame inversion frequency (polarity inversion frequency) is set at 15 Hz and the video signal on which the offset voltage (correction signal) is superposed is applied to the pixel electrode in the comparative example.
Figure 14:
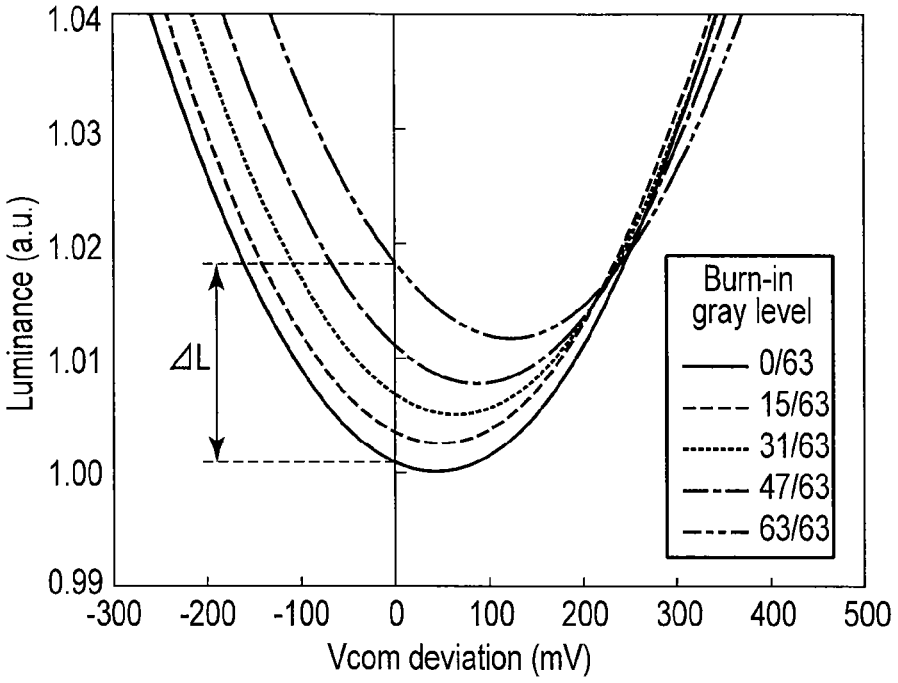
FIG. 14 is a graph showing the changes in luminance with respect to the Vcom deviation when the frame inversion frequency (polarity inversion frequency) is set at 0.9375 Hz and the video signal on which the offset voltage (correction signal) is superposed is applied to the pixel electrode in the comparative example.

FIGS. 12, 13, and 14 are graphs showing the changes in luminance with respect to the Vcom deviation at each polarity inversion frequency, which are expected when a video signal on which the offset voltage (FIG. 11) is superposed is applied to a pixel electrode. Note that FIGS. 12, 13, and 14 are expected by using equation (1).

As shown in FIGS. 11, 12, 13, and 14, the minimal-luminance Vcom deviations nearly match on all the burn-in gray levels when the polarity inversion frequency is 60 Hz, but the minimal-luminance Vcom deviations do not match when the polarity inversion frequency is 15 or 0.9375 Hz. This is so because the video signal correction amount (the value of the offset voltage) is insufficient when the polarity inversion frequency is 15 or 0.9375 Hz.

As shown in FIG. 19, in the comparative example in which the offset voltage is superposed on a video signal without taking the polarity inversion frequency into account, ΔL reduces to be equal to that of this embodiment (the first embodiment) when the polarity inversion frequency is 60 Hz. In the comparative example, however, the ΔL reducing effect is inferior to that of this embodiment (the first embodiment) when the polarity inversion frequency is 15 or 0.9375 Hz. Accordingly, the comparative example (FIGS. 11 to 14) has a slight image burn-in improving effect when compared to the case in which no signal correction is performed (FIGS. 4, 5, and 6), but cannot achieve a sufficient image burn-in improving effect.

According to the liquid crystal display device and method of driving the liquid crystal display device according to the first embodiment configured as described above, the liquid crystal display device comprises the array substrate 100, counter substrate 200, liquid crystal layer LQ, and driving unit. The array substrate 100 includes the pixel electrodes PE forming the pixels PX, and the counterelectrode COM. The driving unit applies, to the pixel electrode PE, positive and negative video signals corresponding to the gray level of an image to be displayed by the pixel PX, thereby performing polarity inversion driving.

When applying the video signal to the pixel electrode PE, the driving unit performs correction of superposing a correction signal corresponding to the polarity inversion frequency and gray level on the video signal in advance.

The driving unit superposes a first correction signal corresponding to a first polarity inversion frequency and a gray level on the video signal in a first mode, and superposes a second correction signal corresponding to a second polarity inversion frequency and the gray level in a second mode. The second polarity inversion frequency differs from the first polarity inversion frequency, the first mode is a mode of performing driving at the first polarity inversion frequency, the second mode is a mode of performing driving at the second polarity inversion frequency, and the second correction signal differs from the first correction signal.

Assuming that the first polarity inversion frequency is higher than the second polarity inversion frequency, the voltage value of the first correction signal is not more than that of the second correction signal on each gray level.

In this embodiment, the correction signal is set such that the change amount of the countervoltage Vcom when the average luminance value of an image having a first gray level to be displayed by the pixel PX is minimal is equal to the change amount of the countervoltage Vcom when the average luminance value of an image having a second gray level to be displayed by the pixel PX is minimal, at each polarity inversion frequency. Note that the countervoltage Vcom is a constant voltage at the time of actual use (when displaying an image by performing polarity inversion driving). When setting the correction signal, e.g., when measuring the luminance-Vcom characteristic curve in the testing stage, the voltage value of the countervoltage Vcom is changed.

Consequently, a liquid crystal display device capable of suppressing the image burn-in phenomenon can be obtained even at a polarity inversion frequency different from the standard frequency. In addition, the image burn-in phenomenon can be suppressed even in a liquid crystal display device using low-frequency driving or intermittent driving. This makes it possible to reduce the circuit power, thereby achieving low power consumption.

From the foregoing, it is possible to obtain a liquid crystal display device and method of driving the liquid crystal display device that improve the display quality by suppressing the image burn-in phenomenon.

Next, a liquid crystal display device and a method of driving the liquid crystal display device according to the second embodiment will be explained. In this embodiment, the same reference numerals as in the above-described first embodiment denote the same functional parts, and a detailed explanation thereof will be omitted.

Figure 15:
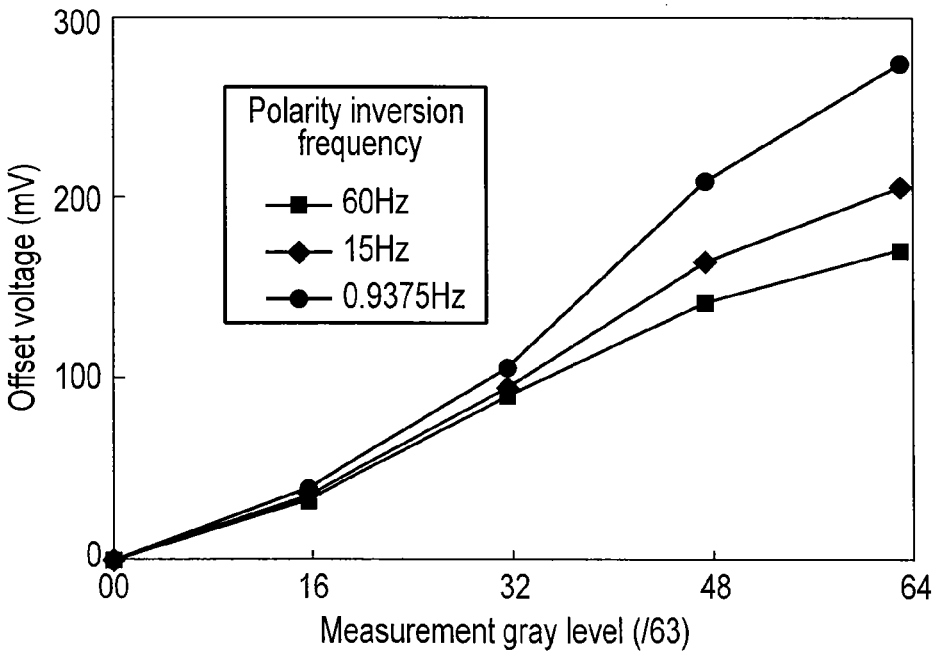
FIG. 15 is a graph showing the changes in offset voltage (correction signal) with respect to a measurement gray level at different frame inversion frequencies (polarity inversion frequencies) in a liquid crystal display device according to a second embodiment.

FIG. 15 is a graph showing an example in which an offset voltage depending on a polarity inversion frequency and gray level is superposed on the average value (DC average value) of positive and negative video signals output from a source driver SD. As shown in FIG. 15, an offset voltage having an independent value is superposed on the video signal in accordance with the polarity inversion frequency and gray level.

Figure 16:
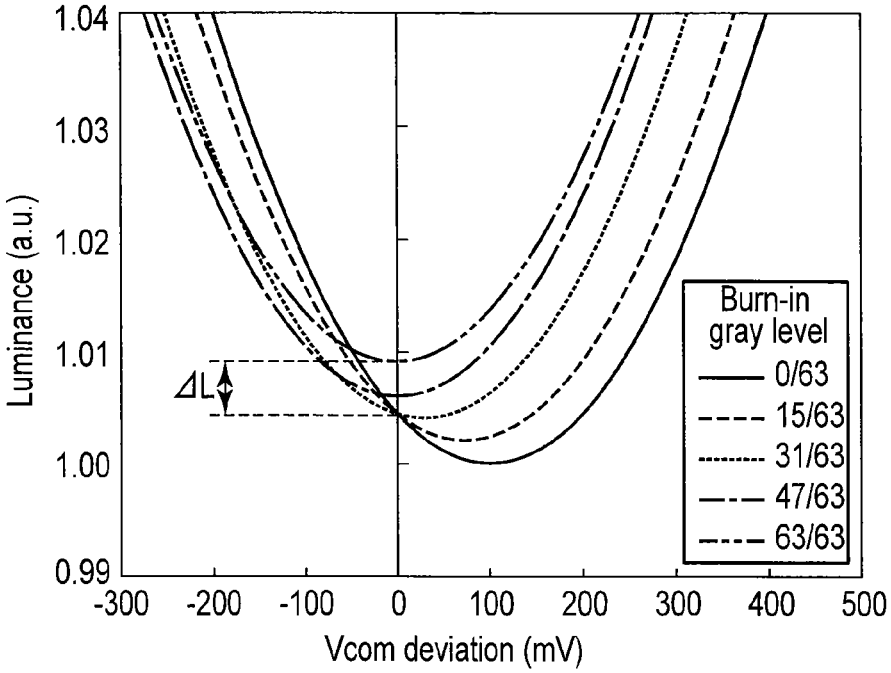
FIG. 16 is a graph showing the changes in luminance with respect to a Vcom deviation when the frame inversion frequency (polarity inversion frequency) is set at 60 Hz and a video signal on which the offset voltage (correction signal) is superposed is applied to a pixel electrode in the second embodiment.
Figure 17:
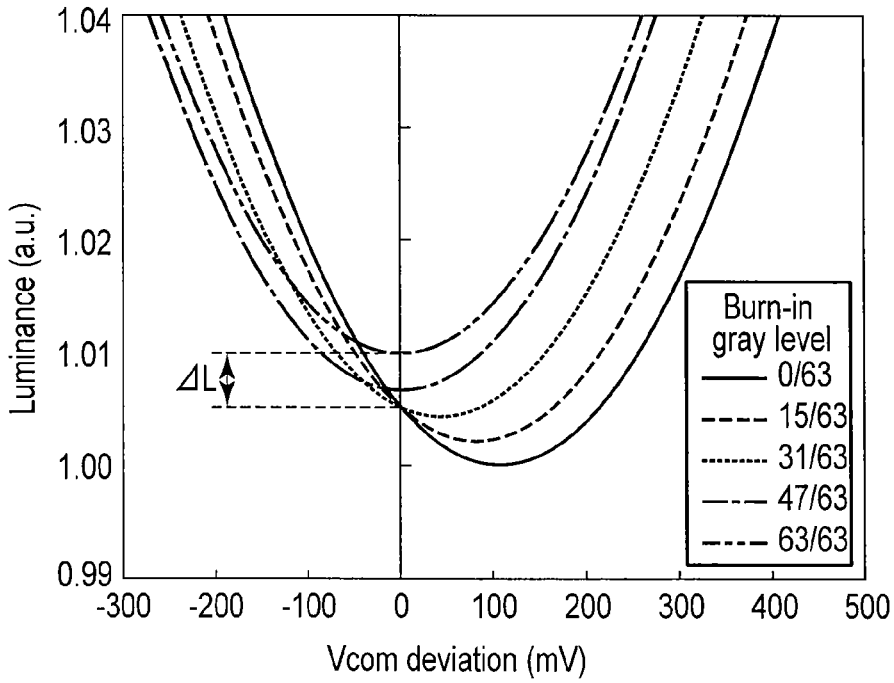
FIG. 17 is a graph showing the changes in luminance with respect to the Vcom deviation when the frame inversion frequency (polarity inversion frequency) is set at 15 Hz and the video signal on which the offset voltage (correction signal) is superposed is applied to the pixel electrode in the second embodiment.

FIGS. 16, 17, and 18 are graphs showing the changes in luminance with respect to a Vcom deviation, which are expected when the video signal on which the offset voltage (FIG. 15) is superposed is applied to a pixel electrode. A measurement gray level is 31/63 (level-3 gray level) in FIGS. 16, 17, and 18 as well.

The correction of the video signal by the offset voltage (FIG. 15) is based on the following idea.

In the above-mentioned first embodiment, the change width (ΔL) of the intercept luminance is decreased by shifting the luminance-Vcom characteristic curve in the horizontal direction in accordance with equation (1). The variable range of the intercept luminance has the following restrictions.

[1] The intercept luminance cannot be made lower than the luminance bottom level. (This is so because the luminance-Vcom characteristic curve is a parabola projecting downward.)

[2] The intercept luminance cannot be varied when the burn-in gray level matches the measurement gray level. (This is so because the first two terms in equation (1) become equal and cancel each other.)

In other words, it is impossible to make the upper limit of ΔL smaller than the maximum value of the luminance bottom level, and make the lower limit of ΔL larger than the intercept luminance.

As shown in FIGS. 15, 16, 17, and 18, the feature of this embodiment is to minimize ΔL under these restrictions, and the following features are obtained by adjusting the correction signal.

(i) At each polarity inversion frequency, the minimal-luminance Vcom deviation corresponding to a burn-in gray level of 63/63 (the condition under which the luminance bottom level is maximum) is nearly 0.

(ii) At each polarity inversion frequency, an intercept luminance corresponding to a burn-in gray level of 0/63 is nearly equal to an intercept luminance corresponding to a burn-in gray level of 31/63 (when the burn-in gray level is equal to the measurement gray level).

When adopting correction using the offset voltage shown in FIG. 15, the luminance-Vcom characteristic curve corresponding to each polarity inversion frequency and burn-in gray level when no signal correction is performed as shown in FIGS. 4, 5, and 6 shifts in the horizontal direction in accordance with equation (1), indicating that features (i) and (ii) described above are certainly satisfied.

As shown in FIG. 19, when signal correction (correction of superposing the correction signal on a video signal) of this embodiment is performed (FIGS. 16, 17, and 18), the ratio is, of course, lower than 100% at any polarity inversion frequency, and is also lower than those of the above-described first embodiment. Accordingly, a very good image burn-in improving effect can be obtained.

According to the liquid crystal display device and method of driving the liquid crystal display device according to the second embodiment configured as described above, the liquid crystal display device comprises the array substrate 100, counter substrate 200, liquid crystal layer LQ, and driving unit. In this embodiment, if a first minimal value as a minimum of the average luminance value of an image which is to be displayed by the pixel PX and has a first gray level is larger than a second minimal value as a minimum of the average luminance value of an image which is to be displayed by the pixel PX and has a second gray level having a luminance level lower than that of the first gray level, at each polarity inversion frequency, a correction signal corresponding to the polarity inversion frequency and first gray level is superposed on a video signal corresponding to the polarity inversion frequency and first gray level, such that the change amount of the countervoltage Vcom is zero when the luminance of the image having the first gray level takes the first minimal value.

In the above-mentioned case, a correction signal corresponding to the polarity inversion frequency and second gray level is further superposed on a video signal corresponding to the polarity inversion frequency and second gray level, so that the luminance of the image having the second gray level takes a predetermined value. This predetermined value is a value deviated from the second minimal value. Note that the countervoltage Vcom is a constant voltage in an actual use (when displaying an image by performing polarity inversion driving).

Consequently, it is possible to obtain a liquid crystal display device capable of further suppressing the image burn-in phenomenon, and capable of suppressing the burn-in phenomenon even at a polarity inversion frequency different from the standard frequency. In addition, the image burn-in phenomenon can be suppressed even in a liquid crystal display device using low-frequency driving or intermittent driving. This can achieve a low power consumption.

From the foregoing, it is possible to obtain the liquid crystal display device and method of driving the liquid crystal display device that improve the display quality by suppressing the image burn-in phenomenon.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, when giving a liquid crystal display device the function of low-frequency driving or intermittent driving, it is necessary to determine whether to perform low-frequency driving or intermittent driving, and select a polarity inversion frequency when performing low-frequency driving or intermittent driving, in accordance with conditions such as user's mode selection (e.g., a power-saving mode) and a display image (e.g., a still image or moving image). It is possible to perform this determination by a control circuit (e.g., a CPU) of an apparatus main body (e.g., the main body of a smartphone or tablet PC), and send a control signal to the controller (driving unit) of the liquid crystal display device. It is also possible to cause the control circuit itself of the liquid crystal display device to perform the determination. In either case, the control circuit of the liquid crystal display device recognizes the polarity inversion frequency in real time. Therefore, when offset voltage (correction signal) information is prestored as a table in a memory of the control circuit, an optimal offset correction voltage can be selected in accordance with the real-time polarity inversion frequency.

The polarity inversion frequency can be selected from several conditions (e.g., selected from the three conditions, i.e., 60, 15, and 0.9375 Hz in the previously described embodiments), and can also be continuously set (e.g., continuously varied between 60 and 0.1 Hz). In the latter case, it is possible to store, in a memory, offset voltages for some discrete conditions within a frequency interval, and obtain an optimal offset voltage by an interpolating calculation (line graph approximation) as needed.

Note that the above-described embodiments have been explained by assuming that the countervoltage Vcom is a constant voltage in an actual use (when displaying an image by performing polarity inversion driving). However, even when the positive and negative values of the countervoltage Vcom are different, such as when performing common-line inversion driving (driving in which even- and odd-numbered lines have opposite signal polarities, and the signal polarity is inverted for each frame), video signal correction is applicable as in the above-described embodiments. When measuring the luminance-Vcom characteristic curve in this case, the values of the countervoltages Vcom having the positive and negative polarities are changed while maintaining a given difference between them.

Furthermore, the embodiments of the present invention are not limited to the above-mentioned liquid crystal display device and method of driving the liquid crystal display device, and are applicable to various kinds of liquid crystal display devices and methods of driving the liquid crystal display devices.

What is claimed is:

1. A liquid crystal display device comprising:

an array substrate comprising a pixel electrode forming a pixel, and a counterelectrode arranged opposite to the pixel electrode with an insulating layer being interposed therebetween and forming the pixel;

a counter substrate arranged opposite to the array substrate;

a liquid crystal layer held between the array substrate and the counter substrate; and a driving unit configured to perform polarity inversion driving by applying, to the pixel electrode, positive and negative video signals corresponding to a gray level of an image to be displayed by the pixel, wherein when applying the video signals to the pixel electrode, the driving unit superposes a correction signal corresponding to a polarity inversion frequency and the gray level on the video signals in advance, the polarity inversion frequency comprises a first polarity inversion frequency and a second polarity inversion frequency, the correction signal comprises a first correction signal and a second correction signal, the first polarity inversion frequency is higher than the second polarity inversion frequency, and a voltage value of the first correction signal is not more than a voltage value of the second correction signal for each gray level.

2. The device according to claim 1, wherein in a first mode in which driving is performed at the first polarity inversion frequency, the driving unit superposes the first correction signal corresponding to the first polarity inversion frequency and the gray level on the video signals, and in a second mode in which driving is performed at the second polarity inversion frequency different from the first polarity inversion frequency, the driving unit superposes the second correction signal corresponding to the second polarity inversion frequency and the gray level and different from the first correction signal on the video signals.

3. The device according to claim 2, wherein the first correction signal and the second correction signal are bias voltages.

4. The device according to claim 1, wherein the driving unit is preset to superpose the correction signal corresponding to the polarity inversion frequency and the gray level on the video signals.

5. The device according to claim 1, wherein the correction signal is set such that a change amount of a countervoltage applied to the counterelectrode when an average luminance value of an image which is to be displayed by the pixel into which a first video signal is burned-in and has a first gray level is minimal is equal to a change amount of the countervoltage when an average luminance value of an image which is to be displayed by the pixel into which a second video signal is burned-in and has a second gray level different from the first gray level is minimal, at each polarity inversion frequency.

6. The device according to claim 1, wherein the correction signal is set such that when a first minimal value as a minimum of an average luminance value of an image which is to be displayed by the pixel into which a first video signal is burned-in and has a first gray level is larger than a second minimal value as a minimum of an average luminance value of an image which is to be displayed by the pixel into which a second video signal is burned-in and has a second gray level having a luminance level lower than that of the first gray level, at each polarity inversion frequency, a change amount of a countervoltage applied to the counterelectrode is zero when a luminance of the image having the first gray level takes the first minimal value.

7. The device according to claim 6, wherein the driving unit superposes the correction signal corresponding to the polarity inversion frequency and the first gray level on the first video signal corresponding to the polarity inversion frequency and the first gray level, such that the change amount of the countervoltage is zero when the luminance of the image having the first gray level takes the first minimal value, and when the change amount of the countervoltage is zero when the luminance of the image having the first gray level takes the first minimal value, the driving unit superposes the correction signal corresponding to the polarity inversion frequency and the second gray level on the second video signal corresponding to the polarity inversion frequency and the second gray level, such that the luminance of the image having the second gray level takes a predetermined value.

8. The device according to claim 7, wherein the predetermined value is made to deviate from the second minimal value.

9. A method of driving a liquid crystal display device comprising an array substrate comprising a pixel electrode forming a pixel, and a counterelectrode arranged opposite to the pixel electrode with an insulating layer being interposed therebetween and forming the pixel, a counter substrate arranged opposite to the array substrate, a liquid crystal layer held between the array substrate and the counter substrate, and a driving unit, the method comprising:

performing polarity inversion driving by applying, to the pixel electrode, positive and negative video signals corresponding to a gray level of an image to be displayed by the pixel by the driving unit; and when applying the video signals to the pixel electrode, superposing a correction signal corresponding to a polarity inversion frequency and the gray level on the video signals in advance by the driving unit, wherein the polarity inversion frequency comprises a first polarity inversion frequency and a second polarity inversion frequency, the correction signal comprises a first correction signal and a second correction signal, the first polarity inversion frequency is higher than the second polarity inversion frequency, and a voltage value of the first correction signal is not more than a voltage value of the second correction signal for each gray level.

10. The method according to claim 9, wherein in a first mode in which driving is performed at the first polarity inversion frequency, the first correction signal corresponding to the first polarity inversion frequency and the gray level is superposed on the video signals, and in a second mode in which driving is performed at the second polarity inversion frequency different from the first polarity inversion frequency, the second correction signal corresponding to the second polarity inversion frequency and the gray level and different from the first correction signal is superposed on the video signals.

11. The method according to claim 10, wherein the first correction signal and the second correction signal are bias voltages.

12. The method according to claim 9, wherein the correction signal is set such that a change amount of a countervoltage applied to the counterelectrode when an average luminance value of an image which is to be displayed by the pixel into which a first video signal is burned-in and has a first gray level is minimal is equal to a change amount of the countervoltage when an average luminance value of an image which is to be displayed by the pixel into which a second video signal is burned-in and has a second gray level different from the first gray level is minimal, at each polarity inversion frequency.

13. The method according to claim 9, wherein the correction signal is set such that when a first minimal value as a minimum of an average luminance value of an image which is to be displayed by the pixel into which a first video signal is burned-in and has a first gray level is larger than a second minimal value as a minimum of an average luminance value of an image which is to be displayed by the pixel into which a second video signal is burned-in and has a second gray level having a luminance level lower than that of the first gray level, at each polarity inversion frequency, a change amount of a countervoltage applied to the counterelectrode is zero when a luminance of the image having the first gray level takes the first minimal value.

14. The method according to claim 13, wherein the correction signal corresponding to the polarity inversion frequency and the first gray level is superposed on the first video signal corresponding to the polarity inversion frequency and the first gray level, such that the change amount of the countervoltage is zero when the luminance of the image having the first gray level takes the first minimal value, and when the change amount of the countervoltage is zero when the luminance of the image having the first gray level takes the first minimal value, the correction signal corresponding to the polarity inversion frequency and the second gray level is superposed on the second video signal corresponding to the polarity inversion frequency and the second gray level, such that the luminance of the image having the second gray level takes a predetermined value.

15. The method according to claim 14, wherein the predetermined value is made to deviate from the second minimal value.

16. A liquid crystal display device comprising:

an array substrate comprising a pixel electrode forming a pixel, and a counterelectrode arranged opposite to the pixel electrode with an insulating layer being interposed therebetween and forming the pixel;

a counter substrate arranged opposite to the array substrate;

a liquid crystal layer held between the array substrate and the counter substrate; and a driving unit configured to perform polarity inversion driving by applying to the pixel electrode, positive and negative video signals corresponding to a gray level of an image to be displayed by the pixel, wherein when applying the video signals to the pixel electrode, the driving unit superposes a correction signal corresponding to a polarity inversion frequency and the gray level on the video signals in advance, the polarity inversion frequency comprises a first polarity inversion frequency and a second polarity inversion frequency, the correction signal comprises a first correction signal and a second correction signal, the first polarity inversion frequency is higher than the second polarity inversion frequency, and the first correction signal is lower than the second correction signal.

* * * * *